US006526237B2

(12) United States Patent
Endo

(10) Patent No.: US 6,526,237 B2
(45) **Date of Patent: *Feb. 25, 2003**

(54) IMAGE FORMING APPARATUS

(75) Inventor: Saijiro Endo, Odawara (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/563,323

(22) Filed: May 3, 2000

(65) Prior Publication Data

US 2002/0085849 A1 Jul. 4, 2002

(30) Foreign Application Priority Data

May 10, 1999 (JP) ..... 11-128281
Apr. 26, 2000 (JP) ..... 2000-125412

(51) Int. Cl.[7] ..... G03G 15/00
(52) U.S. Cl. ..... 399/49; 399/92; 399/299; 399/302
(58) Field of Search ..... 399/49, 46, 299, 399/300, 302, 308, 313, 92

(56) References Cited

U.S. PATENT DOCUMENTS 5,625,857 A * 4/1997 Shimada et al. ..... 399/49
5,701,569 A * 12/1997 Kanazawa et al. ..... 399/308
5,740,492 A * 4/1998 Deki et al. ..... 399/302 X
5,842,080 A * 11/1998 Ashibe et al. ..... 399/49
5,991,558 A * 11/1999 Emi et al. ..... 399/49
6,038,423 A * 3/2000 Tagawa et al. ..... 399/302 X
6,188,418 B1 * 2/2001 Hata ..... 399/49 X
6,285,849 B1 * 9/2001 Shimada et al. ..... 399/301

FOREIGN PATENT DOCUMENTS

| | | |
|---|---|---|
| JP | 03-255473 | * 11/1991 |
| JP | 09-327943 | 12/1997 |
| JP | 10-020579 | * 1/1998 |
| JP | 10-282809 | * 10/1998 |
| JP | 10-293432 | 11/1998 |
| JP | 11-052637 | * 2/1999 |

* cited by examiner

*Primary Examiner*—Sophia S. Chen
(74) *Attorney, Agent, or Firm*—Fitzpatrick, Cella, Harper & Scinto

(57) ABSTRACT

An image forming apparatus comprises a movable body, image forming structure for forming on the movable body a toner image which is transferred onto a recording material, toner image fixing structure for fixing the toner image on the recording material, and a detector for detecting a detection toner image formed on the movable body by the image forming structure. The detector detects the detection toner image at substantially the farthest location from the toner image fixing structure on a peripheral surface of the movable body.

50 Claims, 6 Drawing Sheets

IMAGE FORMING APPARATUS

BACKGROUND OF THE INVENTION

1. Field of the Invention

This invention relates to an image forming apparatus utilizing an electrophotographic method, such as a copying machine, a printer, a facsimile or the like.

2. Description of the Related Art

In conventional color image forming apparatuses such as copying machines, printers or the like, an intermediate transfer method is used where toner images formed in a plurality of image forming sections are sequentially superimposed on an intermediate transfer body and then transferred onto a recording medium altogether.

An example of an embodiment of an image forming apparatus utilizing this intermediate transfer method will be explained using FIG. 6. First, electrostatic latent images are formed on a plurality of photographic photosensitive drums 101*a,* 101*b,* 101*c,* and 101*d* by using light, magnet, electric charge or the like, and then respective toners having respective colors are provided from respective developers 102*a,* 102*b,* 102*c,* 102*d* to form toner images, thereby developing (visualizing) the electrostatic latent images.

An intermediate transfer belt 103 as an intermediate transfer body is arranged to be suspended by a drive roller 105, a driven roller 106 and a tension roller 107 so as to be disposed opposite each of the photosensitive drums 101*a,* 101*b,* 101*c,* and 101*d* along a straight, horizontal plane, and the toner images formed on the surfaces of the photosensitive drums 101*a,* 101*b,* 101*c,* and 101*d* are sequentially transferred onto the intermediate transfer belt 103 in a superimposed manner by the action of primary transfer blades 104*a,* 104*b,* 104*c* and 104*d,* as primary transfer means, disposed on an opposite side of the intermediate transfer belt 103 from the respective photosensitive drums 101*a,* 101*b,* 101*c,* and 101*d.*

A secondary transfer roller 108 is disposed on a side of the intermediate transfer belt 103 opposite the driven roller 106, as a secondary transfer means, and sheets P composed of papers, synthetic resins or the like serving as recording media are suitably fed from sheet cassettes 109*a,* 109*b,* or a manual feed tray 110 to a position between the intermediate transfer belt 103 and the secondary transfer roller 108 where the toner images transferred on the intermediate transfer belt 103 are re-transferred onto the sheets P by the action of the secondary transfer roller 108.

The sheets P on which the toner images have been transferred are subjected to permanent fixation through heating and pressurizing treatments by a fixing device 111, including upper and lower fixing rollers 111*a,* 111*b,* and then delivered out of the apparatus. Using the photosensitive drums 101*a,* 101*b,* 101*c* and 101*d* as image forming means of Yellow, Magenta, Cyan and Black in a sequential order can give full color images; or using any one of the photosensitive drum 101*a,* 101*b,* 101*c,* or 101*d* can give a single color image (e.g., black).

The image forming apparatus with the above-mentioned intermediate transfer method is structured so that toner images transferred from the photosensitive drums 101*a,* 101*b,* 101*c* and 101*d* as intermediate transfer bodies onto the intermediate transfer belt 103 are read (detected) using an image reading means 112, and that based on image information detected/read, image quality improvement is promoted.

The image reading means 112, for instance, reads the image density of a toner image formed on the intermediate transfer belt 103, and then, based on the information thus obtained, image forming conditions or primary transfer conditions are changed; or relative output image positions of respective photosensitive drums 101*a,* 101*b,* 101*c* and 101*d* are detected based on the positions of the respective color toner images formed on the intermediate transfer belt 103, and then, in order to correct the amount of slippage with respect to the position accuracy, the image forming timing or the image forming positions of the photosensitive drums 101*a,* 101*b,* 101*c* and 101*d* are thereby corrected.

In the aforementioned conventional example, however, the fixing device 111 where the toner image on the sheet P is heated, melted and fixed on the sheet P heats up its surrounding environment because the fixing device 111 is required to generate quite a huge amount of heat to perform its function. Heat thus generated from the fixing device 111 thermally affects various parts arranged around the fixing device, and especially in the case where the heat reaches the intermediate transfer belt 103, thermal expansion of the belt is generated in the vicinity of the fixing device 111, thermal contraction occurs as the belt moves away from the fixing device 111, and rotation of the intermediate transfer belt 103 makes this phenomenon repeating.

Accompanied by the heat stretching and contraction of the intermediate transfer belt 103 as mentioned above, toner images used for detection on the intermediate transfer belt 103 (detection toner images) become stretched and contracted, and especially in the case where toner images with a plurality of colors are superimposed on the intermediate transfer belt 103*a,* color slippage problem in terms of position arises.

Also, the heat capacity of the intermediate transfer belt 103 becomes smaller because of its structural function, so the appearance of influences by the aforementioned heat stretching and contraction are easily observed, and consequently there is posed a problem of lowered image quality, such as color slippage or the like.

In addition, a problem arises where, when the heat of the intermediate transfer belt 103 affects the image reading means 112, this causes optical parts such as optical lenses constituting the image reading means 112 to generate thermal expansion or distortion, thereby lowering the image reading accuracy.

Furthermore, when detection toner images are detected on a peripheral surface of the intermediate transfer belt 103 winding around a roller which supports and suspends the intermediate transfer belt 103, the fixing heat causes a change in the roller diameter, resulting in a lowering of the detecting accuracy.

The same problems as mentioned above occur in image forming apparatuses utilizing conveyance belts for carrying and conveying recording materials in order to sequentially transfer toner images from respective photosensitive drums onto the recording materials.

SUMMARY OF THE INVENTION

It is an object of the present invention to provide an image forming apparatus capable of improving a detecting accuracy of a detecting means which detects toner images formed on a movable body.

Other objects of the present invention will be apparent by reading the following detailed description of the preferred embodiments.

BRIEF DESCRIPTION OF THE DRAWINGS

The above and other objects and features of the present invention are apparent to those skilled in the art from the following preferred embodiments thereof when considered in conjunction with the accompanied drawings, in which.

DETAILED DESCRIPTION OF THE PREFERRED EMBODIMENTS (First Embodiment)

Figure 1:
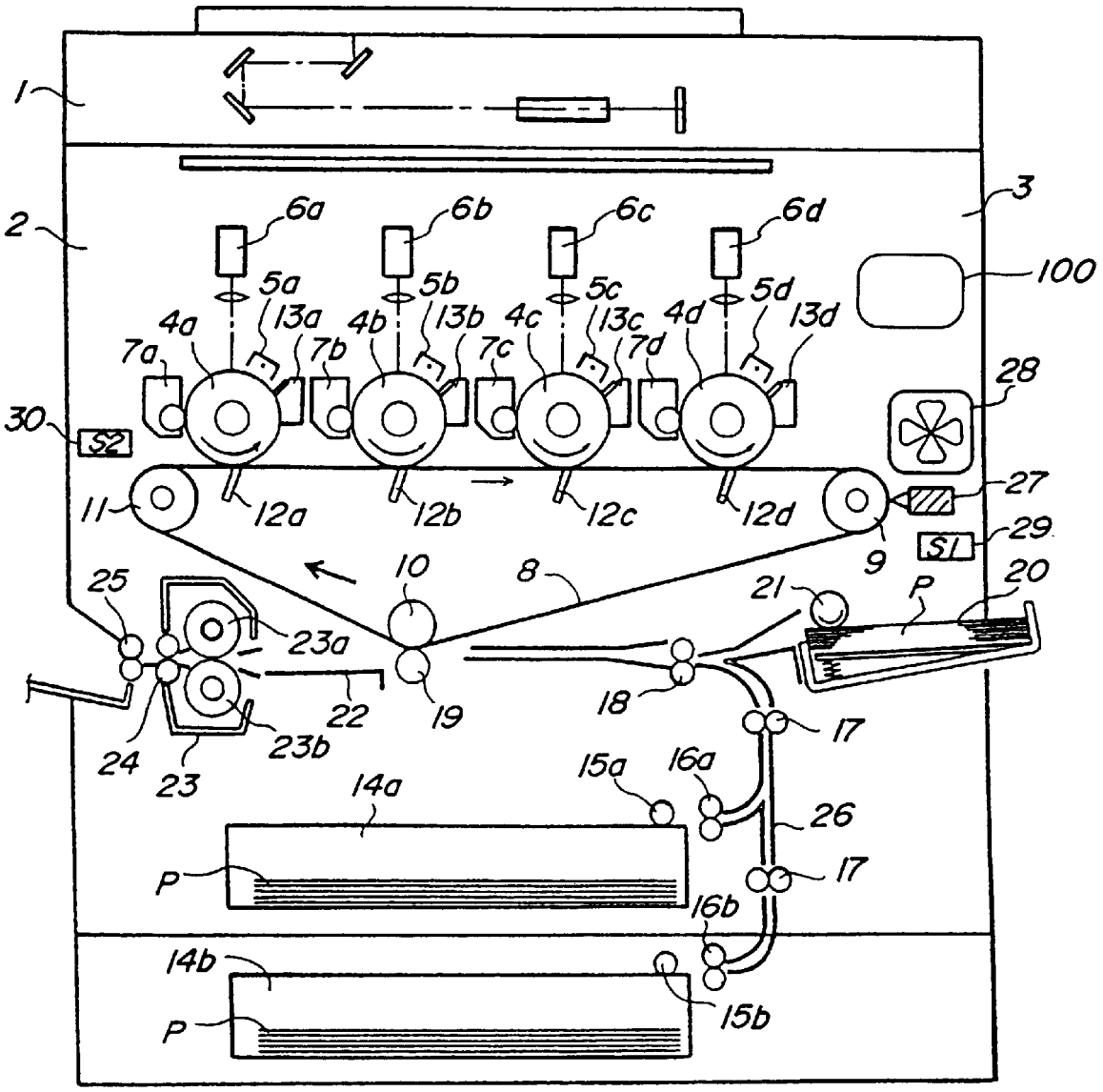
FIG. 1 is a cross-sectional view showing a structure of a first embodiment of an image forming apparatus according to the present invention.
Figure 2:
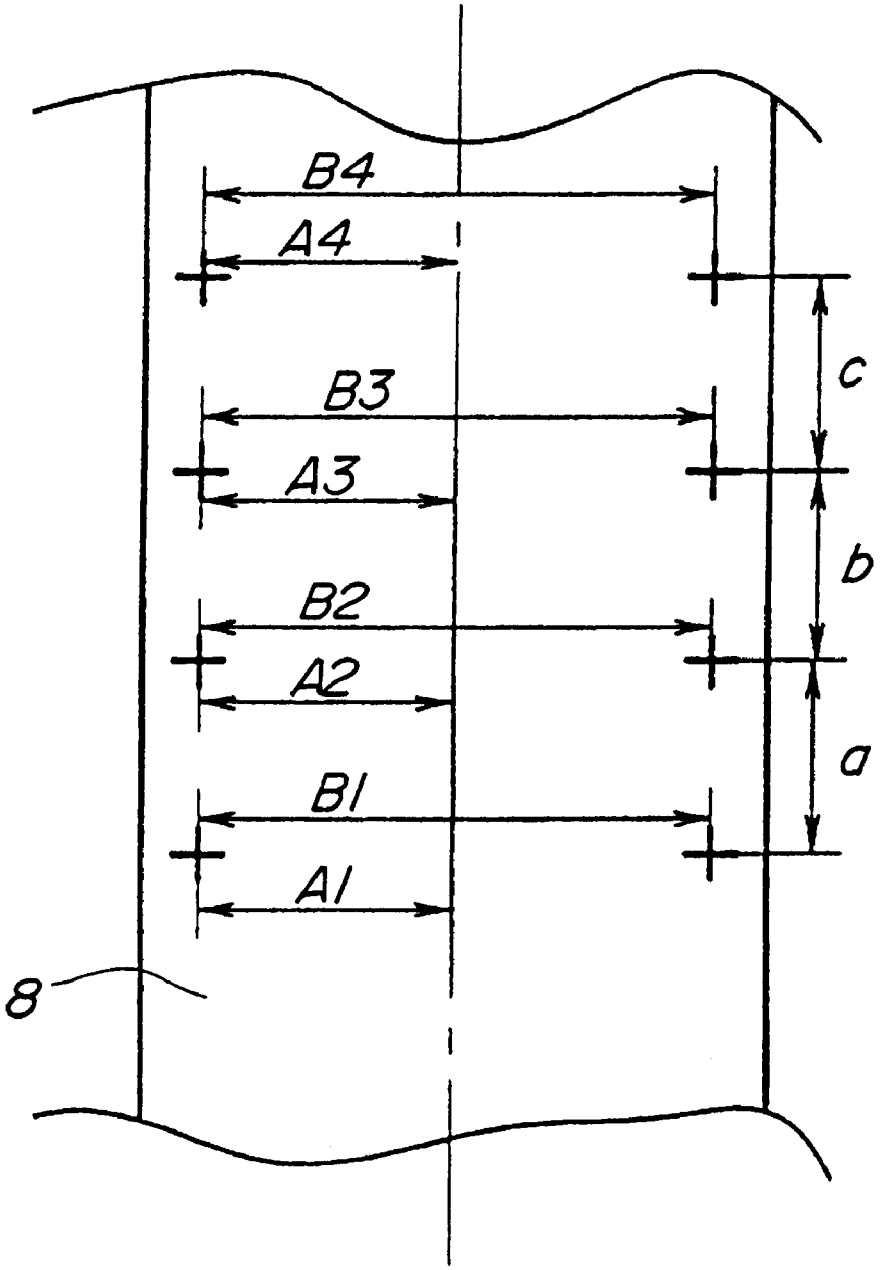
FIG. 2 is an illustration explaining correction of color slippage of four-color toner images.

One embodiment of the image forming apparatus according to the present invention when applied to a full color copying machine utilizing the electrophotographic method will be described in detail with reference to the drawings. FIG. 1 is a cross sectional view showing a structure of a first embodiment of an image forming apparatus according to the present invention, and FIG. 2 is an illustration explaining correction of color slippage of four-color toner images.

First, a structure of the first embodiment of the image forming apparatus according to the present invention will be described by referring to FIG. 1 and FIG. 2. In FIG. 1, numeral 1 refers to an original document image reading apparatus for reading original document images, and numeral 2 refers to an image forming apparatus for forming images on sheets P constituted of papers, synthetic resins or the like based on original document image information read by the original document image reading apparatus 1.

In the upper portion of the image forming apparatus 2, there is arranged an image output section 3 for outputting images in four colors, Yellow, Cyan, Magenta, and Black, in such order starting from the left side in FIG. 1, and electrophotographic photosensitive drums 4*d,* 4*c,* 4*b* and 4*a* as image carriers are pivotally supported so as to be able to rotate on their centers in arrow directions in FIG. 1.

On the outer surfaces of the photosensitive drums 4*d,* 4*c,* 4*b* and 4*a,* primary chargers 5*d,* 5*c,* 5*b,* and 5*a;* optical systems 6*d,* 6*c,* 6*b* and 6*a;* and developing devices 7*d,* 7*c,* 7*b,* and 7*a* are respectively positioned in order starting from an upstream side of the rotating direction of the photosensitive drums 4*d,* 4*c,* 4*b,* and 4*a.*

First, electric charges having a uniform charge for electrification are applied to the surfaces of the photosensitive drums 4*d,* 4*c,* 4*b,* and 4*a* by the primary chargers 5*d,* 5*c,* 5*b,* and 5*a,* thus uniformly charging the surfaces, and then the optical systems 6*d,* 6*c,* 6*b* and 6*a,* are used to radiate laser beams or the like modulated according to the image signals read by the original document image reading apparatus 1 onto the photosensitive drums 4*d,* 4*c,* 4*b,* and 4*a,* thereby forming electrostatic latent images thereon.

Furthermore, developing devices 7*d,* 7*c,* 7*b,* and 7*a,* respectively containing toners serving as respective developing agents of four colors such as Yellow, Cyan, Magenta, and Black positioned in order starting from the left side in FIG. 1, provide the aforementioned electrostatic latent images with toners in each color as mentioned above to form toner images for making them visible.

On the other hand, an intermediate transfer belt 8 constituted of a belt-form member serving as an intermediate transfer body is suspended by rotatable driving roller 9, driven roller 10 and tension roller 11 so as to be opposite each of the photosensitive drums 4*d,* 4*c,* 4*b,* and 4*a,* which are arranged on a straight, horizontal plane, and the toner images formed on the surfaces of the photosensitive drums 4*d,* 4*c,* 4*b* and 4*a* are primarily transferred sequentially and in a superimposed manner on the intermediate transfer belt 8 by applying voltage to primary transfer blades 12*d.* 12*c,* 12*b* and 12*a,* serving as primary transfer means arranged opposite the respective photosensitive drums 4*d,* 4*c,* 4*b,* and 4*a* through the intermediate transfer belt 8.

In a downstream side, in the rotating direction of the photosensitive drums 4*d,* 4*c,* 4*b,* and 4*a,* of respective primary transfer positions on the circumferences of the respective photosensitive drums 4*d,* 4*c,* 4*b,* and 4*a,* to which the primary transfer blades 12*d,* 12*c,* 12*b,* and 12*a* are opposite, also are arranged cleaning devices 13*d,* 13*c,* 13*b* and 13*a,* where residual toners on the photosensitive drums 4*d,* 4*c,* 4*b,* and 4*a* not transferred onto the intermediate transfer belt 8 are scraped off, thereby conducting cleaning of the surfaces of the photosensitive drums 4*d,* 4*c,* 4*b* and 4*a.*

According to the above-mentioned process, image forming operations by respective toners onto the photosensitive drums 4*d,* 4*c,* 4*b* and 4*a* are sequentially conducted.

On the other hand, sheet cassettes 14*a* and 14*b* for containing sheets P constituted of recording materials such as papers, synthetic resins or the like, are provided in the lower portion of the image forming apparatus 2. The sheets P contained in the sheet cassettes 14*a* and 14*b* are brought up by pick-up rollers 15*a* and 15*b,* and then separated and fed sheet by sheet by retard separation roller pairs 16*a,* 16*b,* and further conveyed to a registration roller pair 18 by conveying roller pairs 17.

A sheet P which has been skew corrected by the registration roller pair 18 is fed in synchronization with the rotation of the intermediate transfer belt 8, thus to be conveyed between the intermediate transfer belt 8 and a secondary transfer roller 19 serving as secondary transfer means arranged in a secondary transfer position opposing, through the intermediate transfer belt 8, the driven roller 10; by applying voltage to the secondary transfer roller 19, toner images transferred onto the intermediate transfer belt 8 are secondarily transferred onto the sheet P.

Alternatively, a sheet P brought up by a pick-up roller 21 from a manual feed tray 20, which is skew corrected by the registration roller pair 18, is conveyed between the intermediate transfer belt 8 and the secondary transfer roller 19; by applying voltage to the secondary transfer roller 19, toner images transferred onto the intermediate transfer belt 8 are secondarily transferred onto the sheet P.

The intermediate transfer belt 8 is constituted of resin, for example, such as PET (polyethylene terephthalate), PVDF (poly vinylidene fluoride) or the like, and suspended so as to wind around the driving roller 9, arranged for transferring rotationally driving force to the intermediate transfer belt 8, the tension roller 11, arranged for providing appropriate tension to the intermediate transfer belt 8 by the urging force of a spring (not shown), and the driven roller 10, arranged opposite the secondary transfer roller 19 through the intermediate transfer belt 8.

Between the driving roller 9 and the tension roller 11, the intermediate transfer belt 8 is suspended so as to form a primary transfer flat surface opposing the photosensitive drums 4*d,* 4*c,* 4*b* and 4*a,* which are arranged in a straight line. The driving roller 9 is coated with a rubber layer having a few millimeters thickness on the surface of a metal roller, and consequentially slippage between the driving roller and the intermediate transfer belt 8 can be prevented.

In addition, the driving roller 9 is rotationally driven by a pulse motor (not shown). At the primary transfer positions to which respective photosensitive drums 4*d,* 4*c,* 4*b,* and 4*a* as well as the intermediate transfer belt 8 are opposed, the primary transfer blades 12*d,* 12*c,* 12*b,* and 12*a* serving as the primary transfer means are provided on the backside of the intermediate transfer belt 8.

The driven roller 10, made of metal, is disposed opposite the secondary transfer roller 19 serving as second transfer means, and the driven roller 10 forms the secondary transfer position by providing a nip portion with the intermediate transfer belt 8. Similarly, the tension roller 11 is made of metal. The secondary transfer roller 19 is pressurized by appropriate pressure with respect to the intermediate transfer belt 8.

A sheet P to which toner images formed on the intermediate transfer belt 8 have been transferred by the secondary transfer roller 19 is guided by a sheet guide 22 so as to be conveyed to a fixing device 23 serving as fixing means, by which the toner images are permanently fixed by heating and pressurizing processes, and then the sheet P is conveyed by an internal delivering roller pair 24 and an external delivering roller pair 25 to an exterior tray of the apparatus.

The fixing device 23 has, in its inside, a fixing roller 23*a* storing a heat source such as a halogen heater or the like, and a pressurizing roller 23*b* pressed by the fixing roller 23*a*. A sheet P fed by the sheet guide 22 is subjected to heating and pressurizing processes at the nip portion of the fixing roller 23*a* with the pressurizing roller 23*b,* whereby the toner images are permanently fixed. It is noted that the pressurizing roller 23*b* may have a structure storing heat sources.

Also, a control unit 100 serving as controlling means is provided inside the image forming apparatus 2, and structured to have a controlling base board for controlling the operations of the respective mechanisms of the original document image reading apparatus 1 and the image forming apparatus 2, a motor drive base board for controlling the motor which drives the respective mechanisms, or the like.

Next, the operations of the image forming apparatus 2 with the above-mentioned structure will be described. When an image forming operation signal is issued, the pick-up rollers 15*a,* 15*b,* 21 are selectively driven in a rotational way to bring up the sheets P from the sheet cassettes 14*a,* 14*b* or the manual feed tray 20, and the retard separation roller pairs 16*a,* 16*b* or a separation means not shown feeds out the sheets P piece by piece.

Then, a sheet P is conveyed by the conveying roller pair 17 and then introduced or the like by a sheet guide 26 so as to be conveyed to the registration roller pair 18. At this time, the rotation of the registration roller pair 18 stops, and the front end of the sheet P hits the nip portion of the registration roller pair 18, but is further fed by the conveying roller pair 17 or the pick-up roller 21, thus to form a loop shape in the sheet, and consequently any skew is corrected, with the elasticity of the sheet P, so as to make the front end of the sheet P adjusted along with the nip portion of the registration roller pair 18.

Thereafter, the registration roller pair 18 starts rotating in accordance with timing at which the image forming section including the photosensitive drums 4*d,* 4*c,* 4*b,* and 4*a,* intermediate transfer belt 8, or the like, starts forming images. As for this rotation period of time, the timing is set so that both the toner images primarily transferred onto the intermediate transfer belt 8 from the photosensitive drums 4*d,* 4*c,* 4*b,* and 4*a,* and the sheet P fit in the secondary transfer position of the nip portion consisting of the intermediate transfer belt 8 and the secondary transfer roller 19.

In the image forming section, on the other hand, when an image forming operation starting signal is issued, according to the above-mentioned process, the toner image formed on the photosensitive drum 4*d* positioned in the most upstream side (left side in FIG. 1), in the rotating direction of the intermediate transfer belt 8 is primarily transferred, by the high-voltage applied primary transfer blade 12*d* serving as a primary transfer means onto the intermediate transfer belt 8 at the primary transfer position where the photosensitive drum 4*d* and the primary transfer blade 12*d* oppose each other through the intermediate transfer belt 8.

The primarily transferred toner image is then conveyed to the next primary transfer position at which the photosensitive drum 4*c* and the primary transfer blade 12*c* oppose each other through the intermediate transfer belt 8, where image forming process is conducted by retarding only the time required for conveying the toner image between each of the image forming sections. Registration is adjusted on the transferred toner image, and the next toner image is then transferred onto it. The same steps are sequentially repeated hereinafter, and consequently a toner image having four colors formed on the surfaces of respective photosensitive drum 4*d,* 4*c,* 4*b,* and 4*a* is formed in a superimposed manner on the intermediate transfer belt 8.

Then, the sheet P enters into the nip portion consisting of the intermediate transfer belt 8 and the secondary transfer roller 19, and when the sheet P contacts the intermediate transfer belt 8, high voltage, in accordance with the passing timing of the sheet P, is applied to the secondary transfer roller 19.

According to the aforementioned process, the four color toner image formed on the intermediate transfer belt 8 is transferred onto the surface of the sheet P. Then, the sheet P is accurately fed by the sheet guide 22 to the nip portion of the fixing roller 23*a* with the pressurizing roller 23*b*.

The toner image is permanently fixed on the surface of the sheet P due to the heat of the fixing roller 23*a* and the pressurizing roller 23*b* as well as due to the pressure of the nip portion. The sheet P is thereafter conveyed by the internal delivering roller pair 24 and the external delivering roller pair 25 out of the apparatus.

Using the photosensitive drums 4*d,* 4*c,* 4*b* and 4*a* as image forming means of Yellow, Magenta, Cyan and Black in a sequential order can give full color images; or using any one of the photosensitive drum 4*d,* 4*c,* 4*b* or 4*a* gives a single color image (e.g., black).

In the present embodiment, as shown in FIG. 1, the fixing device 23 as a heat generating source is provided between the driven roller 10 and the tension roller 11 near the lower portion of the intermediate transfer belt 8.

The intermediate transfer belt 8 is suspended by the outer peripheral surface of the driving roller 9, which is arranged at a location approximately farthest from the fixing device 23; image reading means 27 for detecting/reading a detection toner image transferred onto the intermediate transfer belt 8 is provided at this location.

As mentioned above, the image reading means 27 is disposed opposite the roller 9 through the intermediate transfer belt 8, and consequently the detecting accuracy can be improved without up-and-down fluctuation of the belt, when compared with the conventional structure which has no opposing member.

In the vicinities of the image reading means 27 and the tension roller 11, temperature sensors (S1, S2) 29 and 30 serving as temperature measuring means for measuring the internal temperature of the apparatus body are provided, and the control apparatus 100 serving as correcting means corrects, based on the temperature information measured by the temperature sensors 29 and 30, the image information of a toner image transferred onto the intermediate transfer belt 8 read by the image reading means 27.

In the present embodiment, the image reading means 27 functions both as image position detecting means for detecting the relative positions of respective color toner images transferred onto the intermediate transfer belt 8, and as image density detecting means for detecting the density of the respective color toner images.

Next, correcting for positional color slippage of the four-color toner images transferred from the photosensitive drums 4*d,* 4*c,* 4*b,* and 4*a* onto the intermediate transfer belt 8 will be explained with reference to FIG. 2. First, respective color toner images for detection formed on the surfaces of the photosensitive drums 4*d,* 4*c,* 4*b* and 4*a* are transferred onto the intermediate transfer belt 8.

Formation of the respective toner images on the intermediate transfer belt 8 is controlled so that the respective toner images are offset from each other by a predetermined distance. For example, in FIG. 2, the toner images written by way of transfer on the intermediate transfer belt 8 are shown as cross-mark images and the positions of the toner images are read by reading these cross-mark images on the intermediate transfer belt 8 with the image reading means 27 utilizing a CCD (charge-coupled device) or the like.

As shown in FIG. 2, for example, the offset distances a, b, and c between the respective color toner images on the intermediate transfer belt 8 are read/detected, and these distances should be naturally matched with predetermined distances which have been controlled at the time of forming the detection toner images.

But in reality, the positions often slip subtly due to the increased temperature of the inside of the apparatus body, the deformation of, or the mechanical breakdown of the apparatus body, or the like. When the images are superimposed in four colors on the intermediate transfer belt 8 without correcting the amount of the slippage, this causes color slippage which thus appears in the image.

In order to reduce such color slippage, the image reading means 27 detects the slippage amount of the respective color toner images on the intermediate transfer belt 8 as mentioned above, and according to the slippage amount, the timing of writing images (exposure starting timing) to the photosensitive drums 4*d,* 4*c,* 4*b* and 4*a,* or the position of writing images to the photosensitive drums 4*d,* 4*c,* 4*b* and 4*a* is corrected, and as a result, a toner image where the color slippage between four colors has been corrected can be formed on the intermediate transfer belt 8.

The toner image slippage to be corrected includes, in addition to the offset distance a, b, or c between the respective detection color toner images in the moving direction (arrow direction) of the intermediate transfer belt 8 shown in FIG. 8, positional slippage amount A1, A2, A3, or A4, magnification B1, B2, B3, or B4, inclination or the like in a direction perpendicular to the moving direction of the intermediate transfer belt 8 (a direction from one edge of the belt to the other edge) as shown in FIG. 2, and each of those above can be similarly corrected.

As mentioned above, the image reading means 27 is disposed so as to read/detect the detection toner images on the intermediate transfer belt 8, but the detecting position is disposed at a position farthest from the fixing device 23 on the peripheral surface of the intermediate transfer belt 8; in other words, the detecting position is disposed so as to read/detect the detection toner images on the peripheral surface of the intermediate transfer belt 8 supported by the driving roller 9.

Thus, the detecting position is disposed in a place having the least influence of toner splash generated by entering a sheet P with unfixed toner images into the nip portion of the fixing roller 23*a* with the pressurizing roller 23*b,* as well as disposed in a position having the least thermal influence from the fixing device 23.

Also, a cooling fan 28 may be provided for cooling the image reading portion (image reading means 27) as shown in the drawing in order to read, further eliminating the thermal influence by the fixing device 23, detection toner images at the image reading portion by the image reading means 27 on the intermediate transfer belt 8.

When the cooling fan 28 is employed as cooling means, splashing toner generated at the nip portion of the fixing roller 23*a* with the pressurizing roller 23*b* will be blown away by wind pressure around the image reading portion of the image reading means 27, and consequently the image reading portion by the image reading means 27 is not affected by stains.

In addition, since the driving roller 9 for rotationally driving the intermediate transfer belt 8 is located at a position farthest from the fixing device 23, the driving roller 9 will barely be affected by thermal influence from the fixing device 23, and as a result, changing in the diameter of the driving roller 9 by heat expansion is not produced, thereby improving the detecting accuracy, and furthermore, the intermediate transfer belt 8 can conduct stable rotational driving without fluctuation of its rotational driving speed.

The intermediate transfer belt 8 has small heat capacity due to its structural function, and thereby is easily affected by the thermal influence of the fixing device 23; however, at the image reading portion of the image reading means 27, the driving roller 9, which has a larger heat capacity than that of the driven roller 10 or the tension roller 11, contacts the backside of the intermediate transfer belt 8 so as to absorb the heat of the intermediate transfer belt 8. Therefore, the thermal influence on the intermediate transfer belt 8 can be minimized.

In the vicinity of the fixing device 23, the intermediate transfer belt 8 is heated by heat generated by the fixing device 23. As the belt 8 sequentially moves past the photosensitive drums 4*d,* to 4*c,* to 4*b* and to 4*a,* the temperature influence on the belt becomes less, and then the belt is cooled so as to stay in a most stable state in the vicinity of the driving roller 9 disposed in a position farthest from the fixing device 23.

Consequently, the intermediate transfer belt 8 composed of such material as rubber, resin or the like is in the most heat-expanded state in the vicinity of the fixing device 23; on the other hand, it is in the most heat-contracted state in the vicinity of the driving roller 9.

Because the image reading means 27 for reading/detecting the position of the detection toner image on the intermediate transfer belt 8 so as to correct the image forming timing of the respective colors to the respective photosensitive drums 4*d,* 4*c,* 4*b* and 4*d* is disposed in the vicinity of the driving roller 9, the image reading position is a position where the intermediate transfer belt 8 is in the most heat-contracted state, and therefore, position slippage is produced between the aforementioned image reading position and the toner image position at the image forming position by the photosensitive drums 4*d,* 4*c,* 4*b,* and 4*a* having the respective colors.

In order to prevent the color slippage generated by the heat expansion accompanied by such temperature change, the sensors 29 and 30 measure the temperature distribution (the temperature distribution in the moving direction of the intermediate transfer belt) inside the apparatus body; and from these results, stretching and contraction change due to the heat of the intermediate transfer belt 8 is predicted; and from this information, the image information of the toner image read by the image reading means 27 is corrected by the control device 100, and the amount of the color slippage is further reduced, whereby, high quality images can be obtained.

Also, the image reading means 27 may detect, in addition to the toner image position on the intermediate transfer belt 8, the toner image density on the sheet P.

According to the above-mentioned structure, the image reading means 27 is disposed in approximately the farthest position from the fixing device 23 on the intermediate transfer belt 8 for reading the detection toner image. This arrangement can minimize staining of the image reading means 27 by toner splashing in the vicinity of the fixing device 23, and can further minimize the influence of heat generated at the fixing device 23.

In addition, the image reading portion of the image reading means 27 on the intermediate transfer belt 8 is cooled down using the cooling fan 28, and this can further suppress any influence by the heat.

In the case that a temperature sensor for measuring the internal temperature of the apparatus body is provided, preferably at least two are provided in different positions in the moving direction of the intermediate transfer belt, and image correcting means for correcting image information read by the image reading means 27 based on the temperature information measured by the temperature sensor or temperature sensors is provided; errors produced in the image information which is read by the image reading means 27 due to the difference in the temperature distribution inside the apparatus body are corrected by the image correcting means, making it possible to read images with a high degree of accuracy.

(Second Embodiment)

Figure 3:
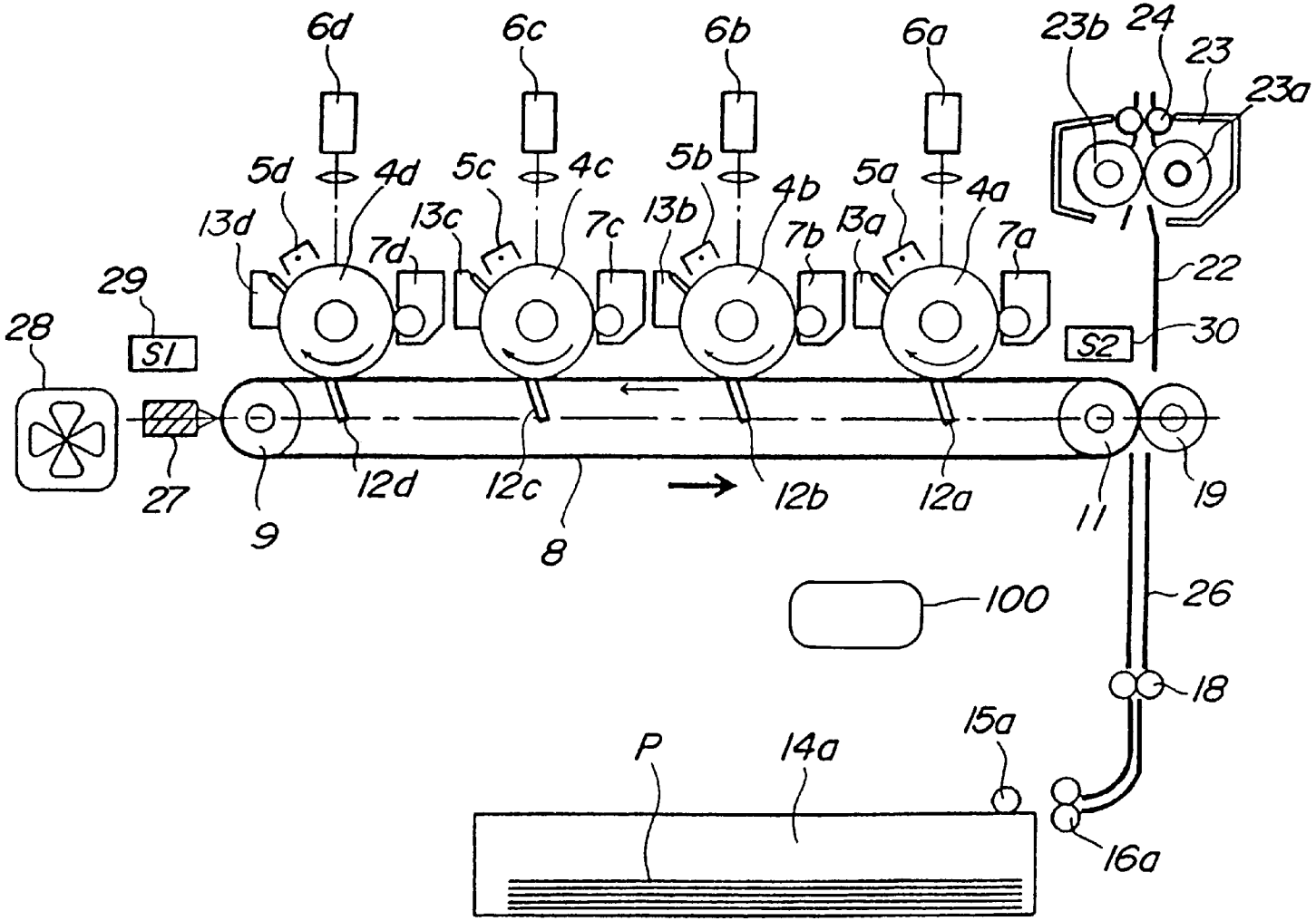
FIG. 3 is a cross-sectional view showing a structure of a second embodiment of the image forming apparatus according to the present invention.

Next, a second embodiment of the image forming apparatus according to the present invention will be described with reference to FIG. 3. FIG. 3 is a cross-sectional view showing a structure of the second embodiment of the image forming apparatus according to the present invention. It is noted that elements having the same reference numbers perform the same functions as those used in the first embodiment, and descriptions thereof therefore are omitted.

In this embodiment, as shown in FIG. 3, an intermediate transfer belt 8 constituted of a belt-form member serving as an intermediate transfer body is suspended by rotatable driving roller 9 and tension roller 11 so as to be opposite each of photosensitive drums 4*d,* 4*c,* 4*b,* and 4*a,* which are arranged along a straight, horizontal plane.

In a position opposite the tension roller 11 through the intermediate transfer belt 8, a secondary transfer roller 19 serving as secondary transfer means is provided, and as in the first embodiment, sheets P contained in a sheet cassette 14*a* are brought up by a pick-up roller 15*a* and then separated and fed sheet by sheet by a retard separation roller pair 16*a,* and further conveyed to a registration roller pair 18 by which the skew of the sheet is corrected. Then, the sheet P is fed by a sheet guide 26 so as to be conveyed in a vertically upward direction between the intermediate transfer belt 8 and the secondary transfer roller 19, and by operation of the secondary transfer roller 19, toner images having been transferred onto the intermediate transfer belt 8 are secondarily transferred onto the sheet P.

The sheet P to which the toner images formed on the intermediate transfer belt 8 have been secondarily transferred by the operation of the secondary transfer roller 19 is guided by a sheet guide 22 so as to be conveyed to a fixing device 23 serving as a fixing means, by which the toner images are permanently fixed by heating and pressurizing processes, and then the sheet P is conveyed by an internal delivering roller pair 24 and an external delivering roller pair 25 (not shown) so as to be delivered out of the apparatus.

In the present embodiment, as shown in FIG. 3, the fixing device 23 as a heat generating source is provided above the tension roller 11 wound with the intermediate transfer belt 8.

On the peripheral surface of the intermediate transfer belt 8 suspended by the outer peripheral surface of the driving roller 9, which is arranged at a location approximately farthest from the fixing device 23, image reading means 27 for reading detection toner images transferred onto the intermediate transfer belt 8 is provided, and in the vicinity of the image reading means 27, a cooling fan 28 serving as cooling means for cooling an image reading portion of the image reading means 27 on the intermediate transfer belt 8 is provided.

In the vicinities of the image reading means 27 and the tension roller 11, temperature sensors 29 and 30 serving as temperature measuring means for measuring the internal temperature of the apparatus body are provided, and correcting means corrects, based on the temperature information measured by the temperature sensors 29 and 30, the image information of the toner image transferred onto the intermediate transfer belt 8 read by the image reading means 27.

In the above structure, the sheet P is fed sheet by sheet from the sheet cassette 14*a* to the pick-up roller 15*a* and the retard separation roller pair 16*a,* and then conveyed by the registration roller pair 18 to a secondary transfer position made of a nip portion of the intermediate transfer belt 8 with the secondary transfer roller 19.

Similarly in the first embodiment, after being formed on the surfaces of the photosensitive drums 4*d,* 4*c,* 4*b* and 4*a,* the toner images having respective colors are primarily transferred onto the intermediate transfer belt 8 by primary transfer blades 12*d,* 12*c,* 12*b* and 12*a* serving as primary transfer means. The intermediate transfer belt 8 is conveyed in an arrow direction in FIG. 3, and the toner images on the intermediate transfer belt 8 are re-transferred onto the sheet P using the secondary transfer roller 19 as secondary transfer means.

The sheet P where the toner images have been re-transferred is heated and pressurized by passing through the fixing device 23, and then, the toner images are permanently fixed thus to be delivered out of the apparatus.

The image reading portion of the image reading means 27 for detecting the toner images on the intermediate transfer belt 8 is disposed at a position farthest from the fixing device 23, which is a heat generating source on the intermediate transfer belt 8, so as to minimize the influence of toner splashing generated at the nip portion of the fixing roller 23a with the pressurizing roller 23*b* in the fixing device 23 to the image reading portion of the image reading means 27 on the intermediate transfer belt 8.

It is especially effective because the toner splashing amount generated at the nip portion of the fixing roller 23*a* with the pressurizing roller 23*b* in the fixing device 23 becomes larger due to the conveying direction, which includes a component of the vertically upward direction according to the present embodiment as shown in FIG. 3.

In addition, since the driving roller 9 for rotationally driving the intermediate transfer belt 8 is located at a position farthest from the fixing device 23, the thermal influence on the intermediate transfer belt 8 can be minimized. Also, changing of the diameter of the driving roller 9 due to the heat stretching and contraction is not produced because the temperature change in the driving roller 9 itself is small, and therefore, the rotational driving speed of the intermediate transfer belt 8 can be stabilized.

Other configurations are structured in the same way as in the first embodiment as mentioned above.

(Third Embodiment)

Figure 4:
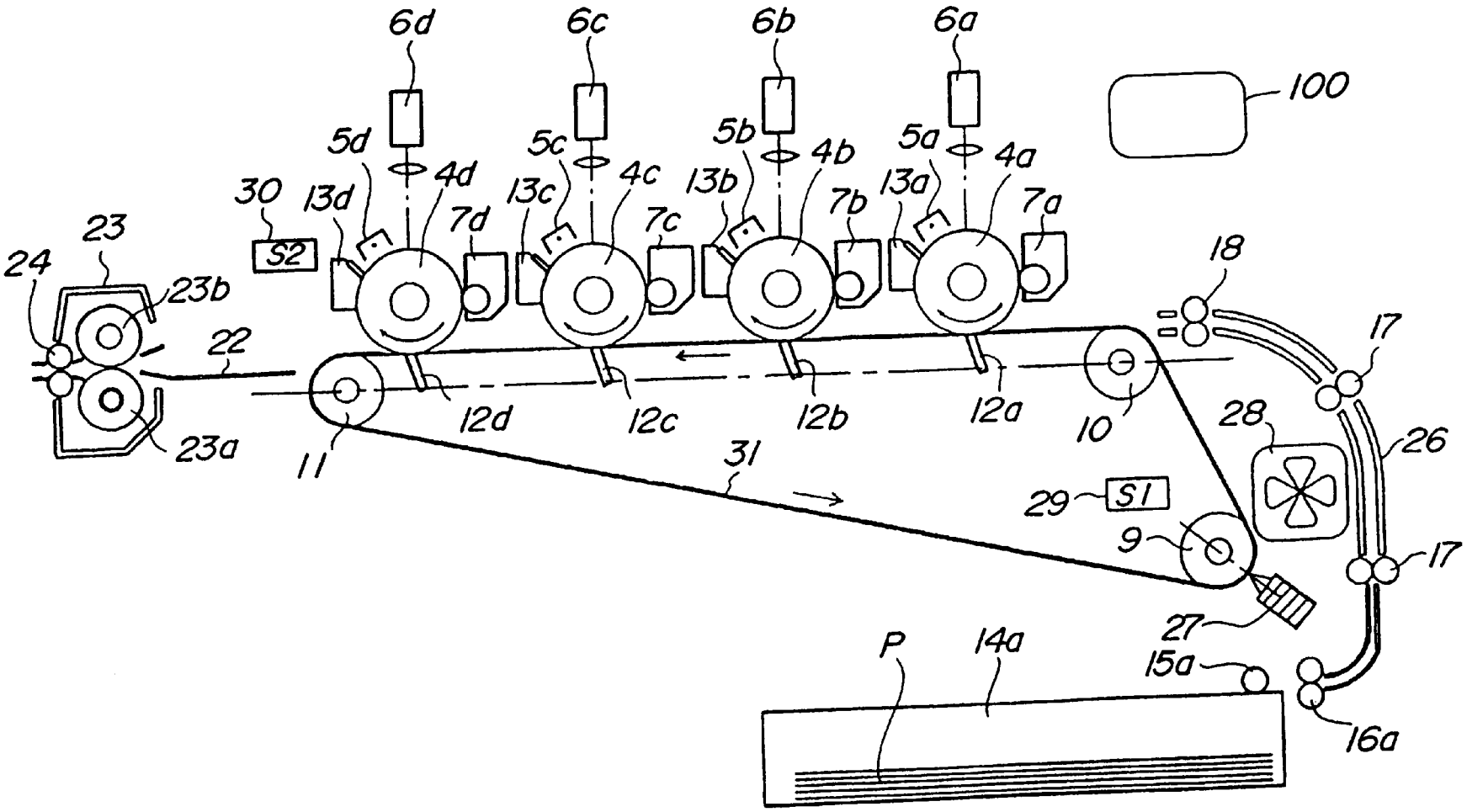
FIG. 4 is a cross-sectional view showing a structure of a third embodiment of the image forming apparatus according to the present invention.

Next, a third embodiment of the image forming apparatus according to the present invention will be described with reference to FIG. 4. FIG. 4 is a cross-sectional view showing a structure of a third embodiment of the image forming apparatus according to the present invention. It is noted that elements having the same reference numbers perform the same functions as those used in the respective previous embodiments and descriptions thereof therefor are omitted.

The respective aforementioned embodiments have a structure where toner images formed on the photosensitive drums 4*d,* 4*c,* 4*b,* and 4*a* are transferred onto the intermediate transfer belt 8 and the transferred toner images on the intermediate transfer belt 8 are further re-transferred onto a sheet P; on the other hand, the present embodiment has a structure where toner images formed on the photosensitive drums 4*d,* 4*c,* 4*b* and 4*a* serving as image carriers are transferred directly onto a sheet P serving as a recording material carried and conveyed by a conveying belt 31, which is constituted of a belt form member serving as a recording material carrier.

As shown in FIG. 4, the conveying belt 31 for carrying and conveying the sheet P to the position where the toner images formed on the photosensitive drums 4*d,* 4*c,* 4*b,* and 4*a* are transferred is suspended by rotatable driving roller 9, driven roller 10 and tension roller 11 so as to be opposite each of the photosensitive drums 4*d,* 4*c,* 4*b,* and 4*a,* which are arranged on a straight, horizontal plane.

Also, the fixing device 23 as a heat generating source is disposed on a plane extending from the conveying belt to which all of the photosensitive drums 4*d,* 4*c,* 4*b* and 4*a* oppose. The conveying belt 31 can be composed of approximately the same resin as that used in the intermediate transfer belt 8 in the respective above-mentioned embodiments.

On the conveying belt 31 suspended by the outer peripheral surface of the driving roller 9 arranged at a location approximately farthest from the fixing device 23, an image reading means 27 for reading the detection toner images transferred from the photosensitive drums 4*d,* 4*c,* 4*b* and 4*a* onto the conveying belt 31 is provided, and in the vicinity of the image reading means 27, a cooling fan 28 serving as cooling means for cooling an image reading portion of the image reading means 27 on the conveying belt 31 is provided.

In the vicinities of the image reading means 27 and the tension roller 11, temperature sensors 29 and 30 serving as temperature measuring means for measuring the internal temperature of the apparatus body are provided, and correcting means corrects, based on the temperature information measured by the temperature sensors 29 and 30, the image information of the detection toner images transferred onto the intermediate transfer belt 8 and read by the image reading means 27.

In order to form images on the sheets P, the sheets P, brought up from a cassette 14*a* by a pick-up roller 15*a* and separated and fed sheet by sheet by a retard separation roller pair 16*a,* are then conveyed by a conveying roller pair 17 to reach, fed by a sheet guide 26, a registration roller pair 18 by which any skew of the sheet is corrected, and then the sheet P is conveyed on the conveying belt 31.

The sheet P placed on the conveying belt 31 passes through, in a state of being carried on the conveying belt 31 by electrostatic attracting force, sequentially under the photosensitive drums 4*d,* 4*c,* 4*b* and 4*a* having the respective colors. On the other hand, the toner images are formed, in the same way as in the aforementioned first embodiment, on the surfaces of the photosensitive drums 4*d,* 4*c,* 4*b* and 4*a* having the respective colors, and when the sheet P is sequentially conveyed to pass through positions to which the respective photosensitive drums 4*d,* 4*c,* 4*b* and 4*a* oppose, the toner images from the photosensitive drums 4*d,* 4*c,* 4*b* and 4*a* having the respective colors are sequentially superimposed by transfer blades 12*d,* 12*c,* 12*b* and 12*a* serving as transferring and charging means for being electrostatically transferred onto the sheet P placed on the conveying belt 31.

The sheet P where the toner images having the respective colors are sequentially superimposed is fed by a sheet guide 22 so as to be conveyed to a fixing device 23 serving as fixing means, by which the toner images are permanently fixed by heating and pressurizing processes, and then the sheet P is conveyed by an internal delivering roller pair 24 and an external delivering roller pair 25 (not shown) so as to be delivered out of the apparatus.

On the other hand, the detection toner images are transferred from the photosensitive drums 4*d,* 4*c,* 4*b* and 4*a* onto the conveying belt 31 at a predetermined timing other than that for operation to form the images on the sheet P, and these toner images are read by the image reading means 27 in the same way as in the aforementioned first embodiment.

The image reading portion of the image reading means 27 on the conveying belt 31 is disposed at a position farthest from the fixing device 23 as a heat generating source on the conveying belt 31, so as to minimize the influence of toner splashing generated at a nip portion of a fixing roller 23*a* with a pressurizing roller 23*b* in the fixing device 23 to the image reading portion of the image reading means 27 on the conveying belt 31.

In addition, since the driving roller 9 for rotationally driving the conveying belt 31 is located at the farthest position from the fixing device 23, the thermal influence to the conveying belt 31 can be minimized. Also, changing in the diameter of the driving roller 9 due to heat stretching and contraction is not produced because the temperature change in the driving roller 9 on itself is small, and therefore, the rotational driving speed of the conveying belt 31 can be stabilized.

After being read by the image reading means 27, the toner images transferred onto the conveying belt 31 are suitably removed by cleaning means (not shown). Other configurations are structured in approximately the same way as in the above-mentioned embodiments, and the same advantage as those in the above-mentioned embodiments can be obtained.

(Fourth Embodiment)

Figure 5:
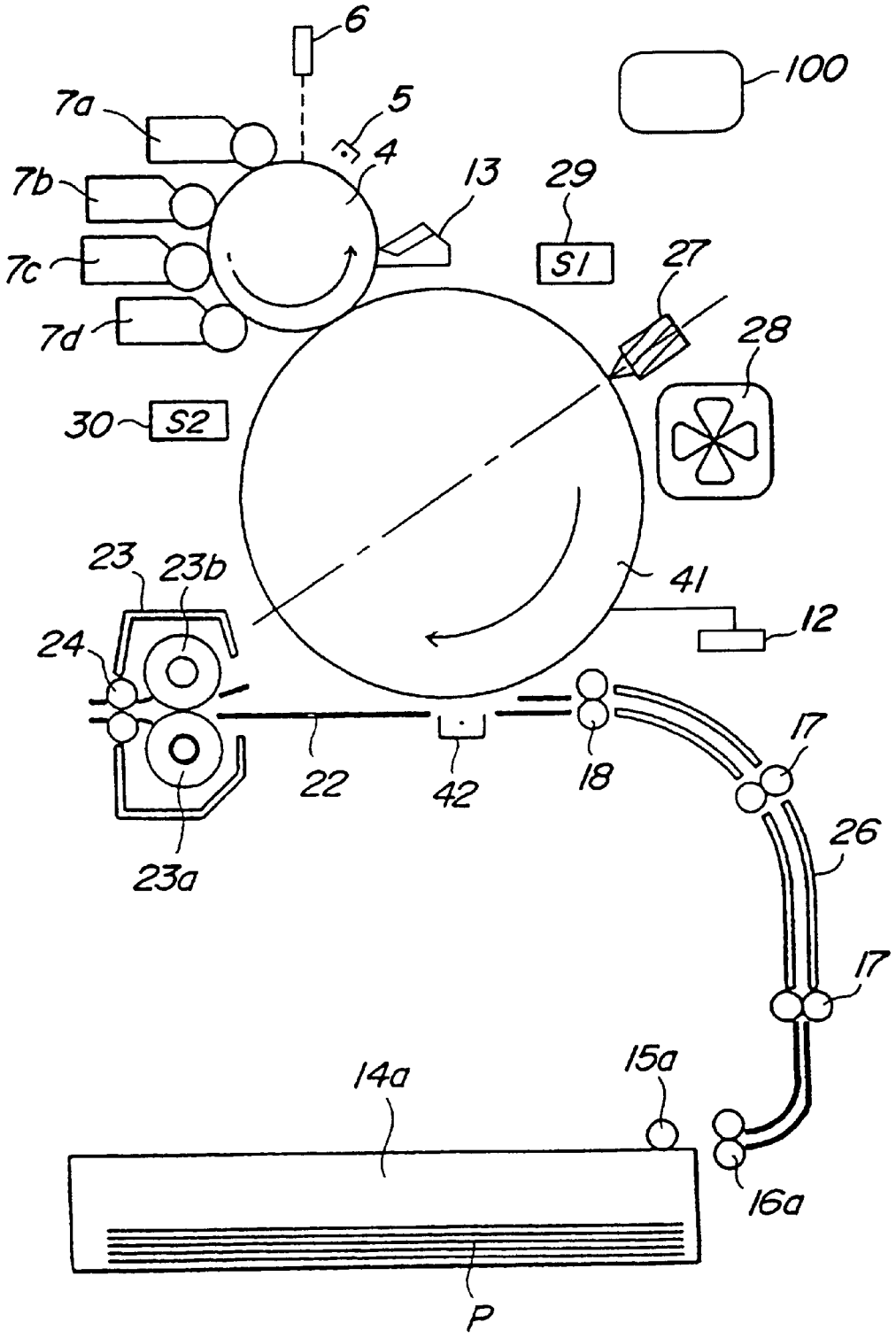
FIG. 5 is a cross-sectional view showing a structure of a fourth embodiment of the image forming apparatus according to the present invention.
Figure 6:
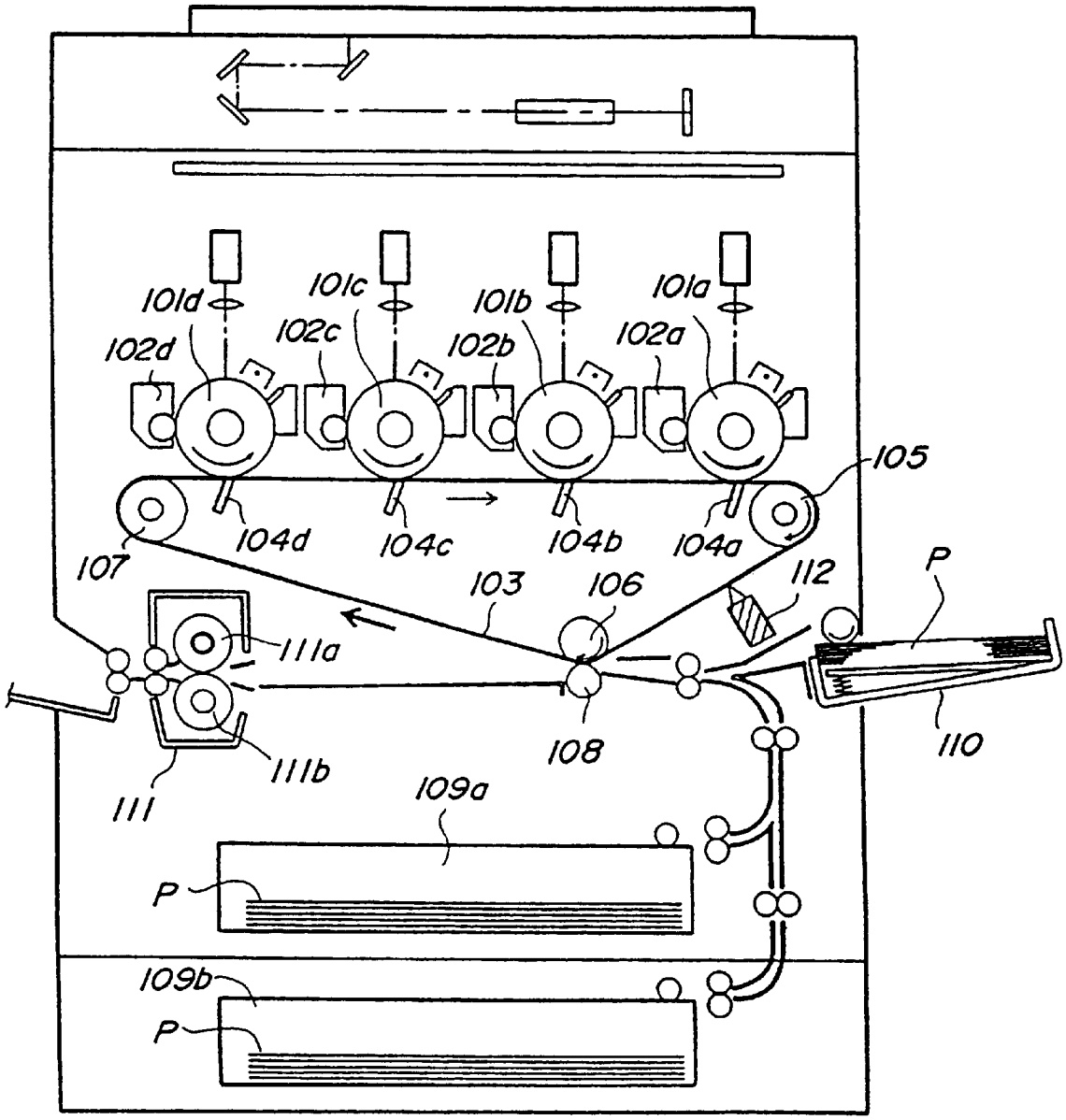
FIG.6 PRIOR ART
FIG. 6 is an illustration explaining a conventional example.

Next, a fourth embodiment of the image forming apparatus according to the present invention will be described with reference to FIG. 5. FIG. 5 is a cross-sectional view showing a structure of a fourth embodiment of the image forming apparatus according to the present invention. It is noted elements having the same reference numbers perform the same functions as those used in the respective previous embodiments and descriptions thereof therefore are omitted.

In the present embodiment as shown in FIG. 5, a single electrophotographic photosensitive drum 4 serving as an image carrier to form toner images is provided, and on the outer surface of the photosensitive drum 4, sequentially provided are developing devices 7*a,* 7*b,* 7*c,* 7*d,* each of which contains a toner having different one of four colors, Yellow, Magenta, Cyan and Black.

On the outer surface of the photosensitive drum 4, a primary charger 5, an optical system 6 and a cleaning means 13 are disposed in approximately the same way as in the first embodiment as mentioned above. Also, an intermediate transfer drum 41 is rotatably disposed opposite the photosensitive drum 4, the intermediate transfer drum 41 serving as intermediate transfer means which secondarily transfers, after a toner image formed on the photosensitive drum 4 is primarily transferred, the primarily transferred toner image onto a sheet P.

The photosensitive drum 4 having a uniformly charged surface is exposed by an exposing means 6 to form an electrostatic latent image. After that, the developing device 7*a,* first, provides toner to develop the toner image, and then, by transfer means 12 to apply voltage to a core metal of the intermediate transfer drum 41, the toner image is primarily transferred onto a surface layer on the core metal of the intermediate transfer drum 41.

Next, an electrostatic latent image is again formed on the photosensitive drum 4, and the developing device 7*b* forms the second color toner image on the photosensitive drum 4, and then the toner image is superimposed on the intermediate transfer drum 41, thus to be transferred, with a timing used for superimposing on the toner image already formed. In the same way, successive toner images formed by the sequential developing devices 7*c* and 7*d,* after formed on the photosensitive drum 4, are then superposed onto the intermediate transfer drum 41.

In the present embodiment, as shown in FIG. 5, a fixing device 23 serving as a heat generating source is disposed near the lower portion of the intermediate transfer drum 41, and image reading means 27 is disposed opposite the fixing device 23 through the intermediate transfer drum 41.

As a result, in approximately the farthest location from the fixing device 23 on the intermediate transfer drum 41, the image reading means 27 for reading the detection toner images transferred onto the intermediate transfer drum 41 is provided, and in the vicinity of the image reading means 27, a cooling fan 28 serving as cooling means for cooling an image reading portion of the image reading means 27 on the intermediate transfer drum 41 is provided.

In the vicinities of the image reading means 27 and the fixing device 23, temperature sensors 29 and 30 serving as temperature measuring means for measuring the internal temperature of the apparatus body are provided, and it is structured so that correcting means corrects, based on the temperature information measured by the temperature sensors 29 and 30, the image information of the detection toner image transferred onto the intermediate transfer drum 41 read by the image reading means 27.

In the same way as in the first embodiment, sheets P, brought up from a cassette 14*a* by a pick-up roller 15*a* and separated and fed sheet by sheet by a retard separation roller pair 16*a,* are then conveyed by a conveying roller pair 17 to reach, fed by a sheet guide 26, a registration roller pair 18 by which any skew of the sheet is corrected, and then the sheet P is conveyed, in a timing so as to match with the toner images superimposed on the intermediate transfer drum 41, to a portion between the intermediate transfer drum 41 and a secondary transfer charging device 42, disposed opposite the intermediate transfer drum 41, serving as secondary transfer means. The toner images transferred onto the intermediate transfer drum 41 are secondarily transferred onto the sheet P by operation of the secondary transfer charging device 42 composed of a charging wire or the like.

The sheet P to which the toner images formed on the intermediate transfer drum 41 have been secondarily transferred by operation of the secondary transfer charging device 41 is guided by a sheet guide 22 so as to be conveyed to a fixing device 23 serving as fixing means, by which the toner images are permanently fixed by heating and pressurizing processes, and then the sheet P is conveyed by an internal delivering roller pair 24 and an external delivering roller pair 25 (not shown) so as to be delivered out of the apparatus.

The image reading portion of the image reading means 27 on the intermediate transfer drum 41 is disposed at the position farthest from the fixing device 23 as a heat generating source on the intermediate transfer drum 41, so as to minimize the influence of toner splashing generated at a nip portion of a fixing roller 23*a* with a pressurizing roller 23*b* in the fixing device 23 to the image reading portion of the image reading means 27 on the intermediate transfer drum 41.

In addition, the cooling fan 28 arranged around the image reading means 27 cools down the image reading means 27, so as to prevent the thermal factor from deteriorating the reading accuracy of the toner images for detection by the image reading means 27.

By arranging the temperature sensors 29 and 30 inside the apparatus body, the shape change of the intermediate transfer drum 41 due to heat is predicted, and based on the prediction value, the image information of the detection toner images read by the image reading means 27 can be corrected, thus capable of achieving the improvement in the reading accuracy.

Other configurations are structured in the same way as in the first embodiment as mentioned above, and substantially the same advantages can be obtained.

The embodiments according to the present invention were described hereinbefore, but the present invention is not limited to these, and various modifications can be made within the idea of the present invention.

What is claimed is:

1. An image forming apparatus comprising:

a movable body;

image forming means for forming on said movable body a toner image, which is transferred onto a recording material;

fixing means for fixing the toner image on the recording material; and detecting means for detecting a detection toner image formed on said movable body by said image forming means; and cooling means for cooling a vicinity of said detecting means, wherein said detecting means detects the detection toner image at a location substantially farthest from said fixing means on a peripheral surface of said movable body.

2. The image forming apparatus according to claim 1, further comprising control means for controlling image forming conditions of said image forming means based on detection results detected by said detecting means.

3. The image forming apparatus according to claim 2, wherein said control means controls the density of the toner image formed on said movable body.

4. The image forming apparatus according to claim 1, wherein said image forming means has a plurality of image carriers, each of which carries a toner image of one of a plurality of colors, each toner image in each color on each image carrier sequentially being superimposed over one another and transferred onto said movable body.

5. The image forming apparatus according to claim 4, further comprising control means for controlling timing of forming toner images on respective image carriers.

6. The image forming apparatus according to claim 4, further comprising control means for controlling densities of respective toner images formed on respective image carriers.

7. The image forming apparatus according to any one of claims 1 to 6, wherein said cooling means has a cooling fan.

8. The image forming apparatus according to claim 1, wherein said detecting means is provided at a location substantially farthest from said fixing means on a peripheral surface of said movable body.

9. An image forming apparatus comprising:

a movable body;

image forming means for forming a toner image on a recording material carried by said movable body;

fixing means for fixing the toner image on the recording material; and detecting means for detecting a detection toner image formed on said movable body by said image forming means; and cooling means for cooling a vicinity of said detecting means, wherein said detecting means detects the detection toner image at a location substantially farthest from said fixing means on a peripheral surface of said movable body.

10. The image forming apparatus according to claim 9, further comprising control means for controlling image forming conditions of said image forming means based on detection results detected by said detecting means.

11. The image forming apparatus according to claim 10, wherein said control means controls the density of the toner image formed on the recording material carried by said movable body.

12. The image forming apparatus according to claim 9, wherein said image forming means has a plurality of image carriers, each of which carries a toner image of one of a plurality of colors, each toner image in each color on each image carrier sequentially being superimposed over one another and transferred to the recording material carried by said movable body.

13. The image forming apparatus according to claim 12, further comprising control means for controlling timing of forming toner images on respective image carriers.

14. The image forming apparatus according to claim 12, further comprising control means for controlling densities of respective toner images formed on respective image carriers.

15. The image forming apparatus according to any one of claims 9 to 14, wherein the cooling means has a cooling fan.

16. The image forming apparatus according to claim 9, wherein said detecting means is provided at a location substantially farthest from said fixing means on a peripheral surface of said movable body.

17. An image forming apparatus comprising:

a belt body;

a plurality of rollers supporting said belt body;

image forming means for forming on said belt body a toner image, which is transferred onto a recording material;

fixing means for fixing the toner image formed on the recording material;

detecting means for detecting a detection toner image formed on said belt body by said image forming means; and cooling means for cooling a vicinity of said detecting means, wherein said detecting means detects the detection toner image at a location on said belt body supported by a roller of said plurality of rollers placed farthest from said fixing means.

18. The image forming apparatus according to claim 17, further comprising control means for controlling image forming conditions of said image forming means based on detection results detected by said detecting means.

19. The image forming apparatus according to claim 18, wherein said control means controls the density of the toner image formed on said belt body.

20. The image forming apparatus according to claim 17, wherein said image forming means has a plurality of image carriers, each of which carries a toner image of one of a plurality of colors, each toner image in each color on each image carrier sequentially being superimposed over one anther and transferred onto said belt body.

21. The image forming apparatus according to claim 20, further comprising control means for controlling timing of forming toner images on respective image carriers.

22. The image forming apparatus according to claim 20, further comprising control means for controlling densities of respective toner images formed on respective image carriers.

23. The image forming apparatus according to any one of claims 17 to 22, wherein said cooling means has a cooling fan.

24. The image forming apparatus according to claim 17, wherein said detecting means detects a detection toner image on the belt body supported by a driving roller for rotationally rotating said belt body.

25. The image forming apparatus according to claim 24, wherein said driving roller has a rubber layer on a roller surface thereof.

26. The image forming apparatus according to claim 17, wherein said detecting means is provided around a location on a peripheral surface of said belt body supported by a roller of said plurality of rollers placed farthest from said fixing means.

27. An image forming apparatus comprising:

a belt body;

a plurality of rollers supporting said belt body;

image forming means for forming a toner image on a recording material carried by said belt body;

fixing means for fixing the toner image on the recording material;

detecting means for detecting a detection toner image formed on said belt body by said image forming means; and cooling means for cooling a vicinity of said detecting means, wherein said detecting means detects the detection toner image at a location on said belt body supported by a roller of said plurality of rollers placed farthest from said fixing means.

28. The image forming apparatus according to claim 27, further comprising control means for controlling image forming conditions of said image forming means based on detection results detected by said detecting means.

29. The image forming apparatus according to claim 28, wherein said control means controls the density of the toner image formed on a recording material carried on said belt body.

30. The image forming apparatus according to claim 27, wherein said image forming means has a plurality of image carriers, each of which carries a toner image of one of a plurality of colors, each toner image in each color on each image carrier sequentially being superimposed over one another and transferred onto the recording material carried by said belt body.

31. The image forming apparatus according to claim 30, further comprising control means for controlling timing of forming toner images on respective image carriers.

32. The image forming apparatus according to claim 30, further comprising control means for controlling densities of respective toner images formed on respective image carriers.

33. The image forming apparatus according to any one of claims 27 to 32, wherein said cooling means has a cooling fan.

34. The image forming apparatus according to claim 27, wherein said detecting means detects the detection toner image on said belt body supported by a driving roller that rotates said belt body.

35. The image forming apparatus according to claim 34, wherein said driving roller has a rubber layer on a roller surface thereof.

36. The image forming apparatus according to claim 27, wherein said detecting means is provided around a location on a peripheral surface of said belt body supported by the roller of said plurality of rollers placed farthest from said fixing means.

37. An image forming apparatus comprising:

a belt body;

a plurality of rollers supporting said belt body;

image forming means for forming a toner image on said belt body;

transfer means for transferring the toner image formed on said belt body onto a recording material;

fixing means for fixing the toner image formed on the recording material using heat; and detecting means for detecting a detection toner image formed on said belt body by said image forming means, wherein one of the plurality of rollers is a driving roller for driving said belt body, said driving roller is placed at a location farthest from said fixing means, and said detecting means detects the detection toner image at a position supported by said driving roller, and wherein a heat capacity of said driving roller is larger than a heat capacity of other rollers of said plurality of rollers.

38. The image forming apparatus according to claim 37, further comprising control means for controlling image forming conditions of said image forming means based on detection results detected by said detecting means.

39. The image forming apparatus according to claim 38, wherein said control means controls the density of the toner image formed on said belt body.

40. The image forming apparatus according to claim 37, wherein said image forming means has a plurality of image carriers, each of which carries a toner image sequentially being superimposed over one another onto said belt body.

41. The image forming apparatus according to claim 40, further comprising control means for controlling timing of forming toner images on respective image carriers.

42. The image forming apparatus according to claim 40, further comprising control means for controlling densities of respective toner images formed on respective image carriers.

43. The image forming apparatus according to claim 37, wherein said driving roller has a rubber layer on a roller surface thereof.

44. An image forming apparatus comprising:

a belt body;

a plurality of rollers supporting said belt body;

image forming means for forming a toner image on a recording material carried by said belt body;

fixing means for fixing the toner image on the recording material using heat; and detecting means for detecting a detection toner image formed on said belt body by said image forming means, wherein one of said plurality of rollers is a driving roller for driving said belt body, said driving roller is placed farthest from said fixing means, and said detecting means detects the toner image at a position supported by said driving roller, and wherein a heat capacity of said driving roller is larger than a heat capacity of other rollers of said plurality of rollers.

45. The image forming apparatus according to claim 44, further comprising control means for controlling image forming conditions of said image forming means based on detection results detected by said detecting means.

46. The image forming apparatus according to claim 45, wherein said control means controls the density of the toner image formed on said belt body.

47. The image forming apparatus according to claim 44, wherein said image forming means has a plurality of image carriers, each of which carries a toner image sequentially being superimposed over one another onto said belt body.

48. The image forming apparatus according to claim 47, further comprising control means for controlling timing of forming toner images on respective image carriers.

49. The image forming apparatus according to claim 48, wherein said driving roller has a rubber layer on a roller surface thereof.

50. The image forming apparatus according to claim 44, further comprising control means for controlling densities of respective toner image formed on respective image carriers.

* * * * *

UNITED STATES PATENT AND TRADEMARK OFFICE

CERTIFICATE OF CORRECTION

PATENT NO. : 6,526,237 B2
DATED : February 25, 2003
INVENTOR(S) : Saijiro Endo

It is certified that error appears in the above-identified patent and that said Letters Patent is hereby corrected as shown below:

Column 4,
Line 12, "12d." should read -- 12d, --.

Signed and Sealed this

Fourteenth Day of October, 2003

JAMES E. ROGAN
*Director of the United States Patent and Trademark Office*